US007220184B1

(12) United States Patent
Akers

(10) Patent No.: US 7,220,184 B1
(45) Date of Patent: May 22, 2007

(54) ADJUSTABLE SEESAW

(76) Inventor: Charles A. Akers, P.O. Box 2083, Harbor, OR (US) 97415

( * ) Notice: Subject to any disclaimer, the term of this patent is extended or adjusted under 35 U.S.C. 154(b) by 2 days.

(21) Appl. No.: 11/175,087

(22) Filed: Jul. 5, 2005

(51) Int. Cl.
*A63G 11/00* (2006.01)

(52) U.S. Cl. ..... 472/106; 472/111

(58) Field of Classification Search ..... 472/106, 472/108, 111, 112
See application file for complete search history.

(56) References Cited

U.S. PATENT DOCUMENTS

| | | | | | |
|---|---|---|---|---|---|
| 670,706 | A | * | 3/1901 | Ernst | 482/24 |
| D58,506 | S | | 7/1921 | Schaller | |
| 1,432,746 | A | * | 10/1922 | Downey | 472/4 |
| 1,552,841 | A | | 9/1925 | Hector | |
| 2,184,200 | A | * | 12/1939 | Thomas | 74/41 |
| 2,431,138 | A | | 11/1947 | Ressinger | |
| D257,685 | S | | 12/1980 | Poulin | |
| 4,262,900 | A | | 4/1981 | Vison | |
| D269,538 | S | | 6/1983 | Sinfield et al. | |
| 4,448,411 | A | | 5/1984 | Parker | |
| 4,804,176 | A | | 2/1989 | Goble | |
| 4,877,237 | A | | 10/1989 | Goble | |
| 4,896,877 | A | * | 1/1990 | Moomaw et al. | 472/5 |
| 5,447,474 | A | * | 9/1995 | Chang | 472/113 |
| 5,676,601 | A | | 10/1997 | Saunders | |
| 5,951,406 | A | * | 9/1999 | Steane | 472/111 |
| 6,149,144 | A | * | 11/2000 | Ha | 269/17 |

* cited by examiner

*Primary Examiner*—Kien Nguyen
(74) *Attorney, Agent, or Firm*—Robert J. Harter

(57) ABSTRACT

A seesaw includes a manually rotatable actuator for adjusting the balance of the seesaw to accommodate a weight differential between two riders. After adjusting the seesaw, the actuator automatically locks the adjustment mechanism in place. A rack-and-pinion assembly provides fine adjustment, and a protective cover avoids creating a pinching hazard.

8 Claims, 7 Drawing Sheets

ADJUSTABLE SEESAW

BACKGROUND OF THE INVENTION

1. Field of the Invention

The subject invention generally pertains to playground equipment and more specifically to a seesaw.

2. Description of Related Art

A seesaw is a well-known piece of playground equipment that comprises a pivotal beam balanced on a fulcrum. Two children typically sit at opposite ends of the beam to teeter up and down.

When the two children are of equal weight, they can sit the same distance away from the fulcrum, and the seesaw will be balanced. If there is a weight difference between the children, the seesaw may be imbalanced.

To compensate for such an imbalance, some seesaws include a feature for adjusting the location of the fulcrum relative to the beam, thereby adjusting the relative distance that each child sits away from the fulcrum. U.S. Pat. No. 2,431,138, for example, discloses a seesaw whose balance can be adjusted by selectively setting the beam upon a fulcrum at different points along the beam. Another seesaw, disclosed in U.S. Pat. No. 5,951,406, is balanced by way of an adjustable telescopic beam. Although such adjustable seesaws are effective, they do have their drawbacks.

For the seesaw of the '138 patent, the adjustment mechanism appears to pose a finger pinching hazard as the plank needs to be lifted and set back down in order to adjust its balance. Moreover, two people may be needed at opposite ends of the plank to lift and reposition it. If just one person adjusts the plank, that person would likely lift the plank near its center of gravity, but that is where the potential pinching hazard exists. In operation, if a child "pushes off" especially hard, the child might dislodge the plank from its adjusted position.

For the seesaw of the '406 patent, shot pins help hold the telescopic beam at its adjusted position. If someone fails to install those pins, the seats could unexpectedly slide all the way in or fall out entirely. This could suddenly create a drastic and dangerous imbalance.

Consequently, a need exists for a seesaw that is easier and safer to adjust.

SUMMARY OF THE INVENTION

To provide a seesaw that is easier and safer to adjust, an object of the invention to adjust the balance of a seesaw beam by using a rack-and-pinion assembly.

Another object of some embodiments is to adjust the balance of a seesaw beam without having to lift the beam off its fulcrum.

Another object of some embodiments is to provide a single dual-purpose mechanism that provides a seesaw with both an adjustment feature and a locking feature Another object of some embodiments is to provide an adjustable seesaw with a locking mechanism that automatically locks the beam in position after it has been adjusted.

Another object of some embodiments is to provide a seesaw with an adjustment mechanism whose rotational movement adjusts the seesaw's balance and whose axial translation holds the beam at its adjusted position.

Another object of some embodiments is to provide a seesaw with a locking mechanism that selectively engages and disengages a portion a track follower to selectively inhibit and permit the adjustment of the seesaw.

Another object of some embodiments is to provide an adjustable seesaw with a protective cover that permits the adjustment of the seesaw yet avoids creating a pinching hazard.

Another object of some embodiments is to provide a seesaw with an adjustment mechanism that can easily be adjusted and subsequently locked with a simple hand motion.

One or more of these and/or other objects of the invention are provided by a seesaw that includes a rack-and-pinion assembly for adjusting the balance of the seesaw.

DESCRIPTION OF THE PREFERRED EMBODIMENT

Figure 1:
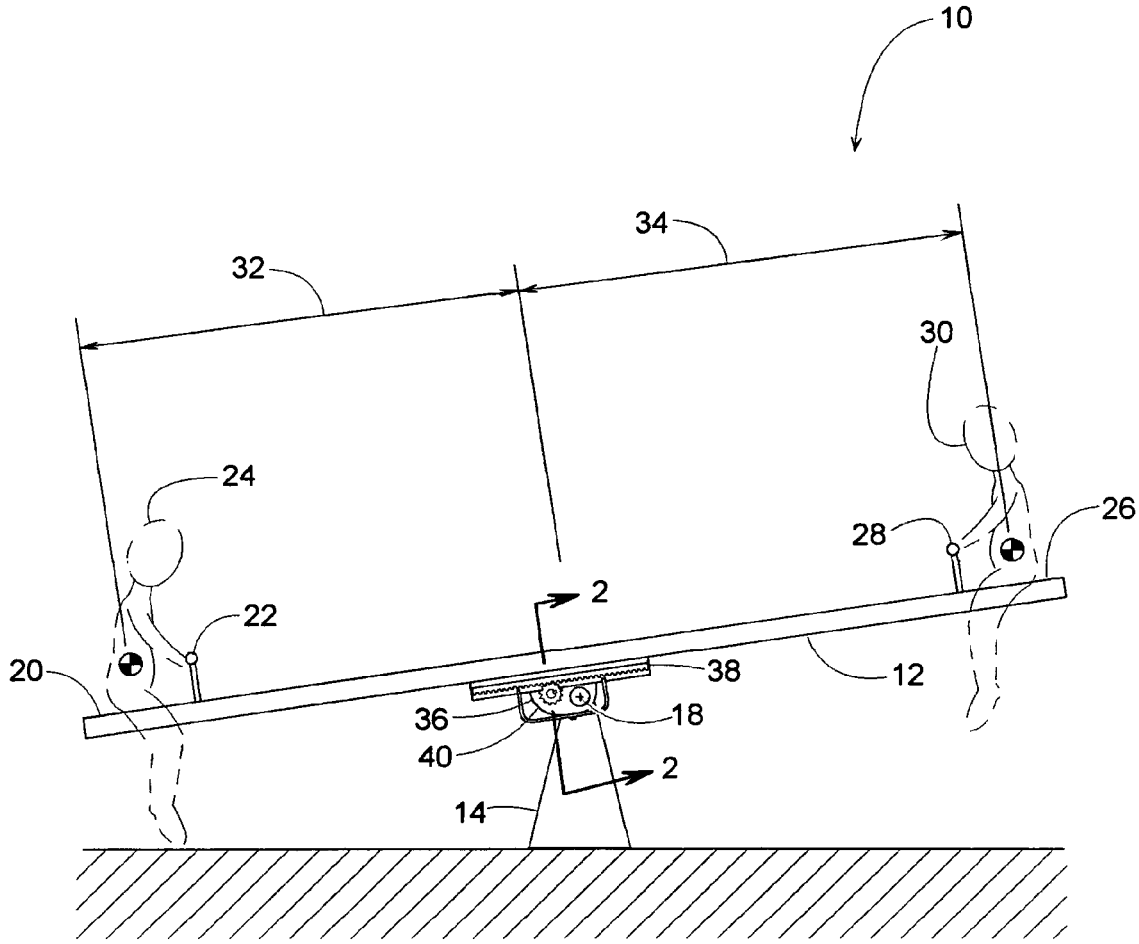
FIG. 1 is a side view of a seesaw according to one embodiment of the invention.
Figure 2:
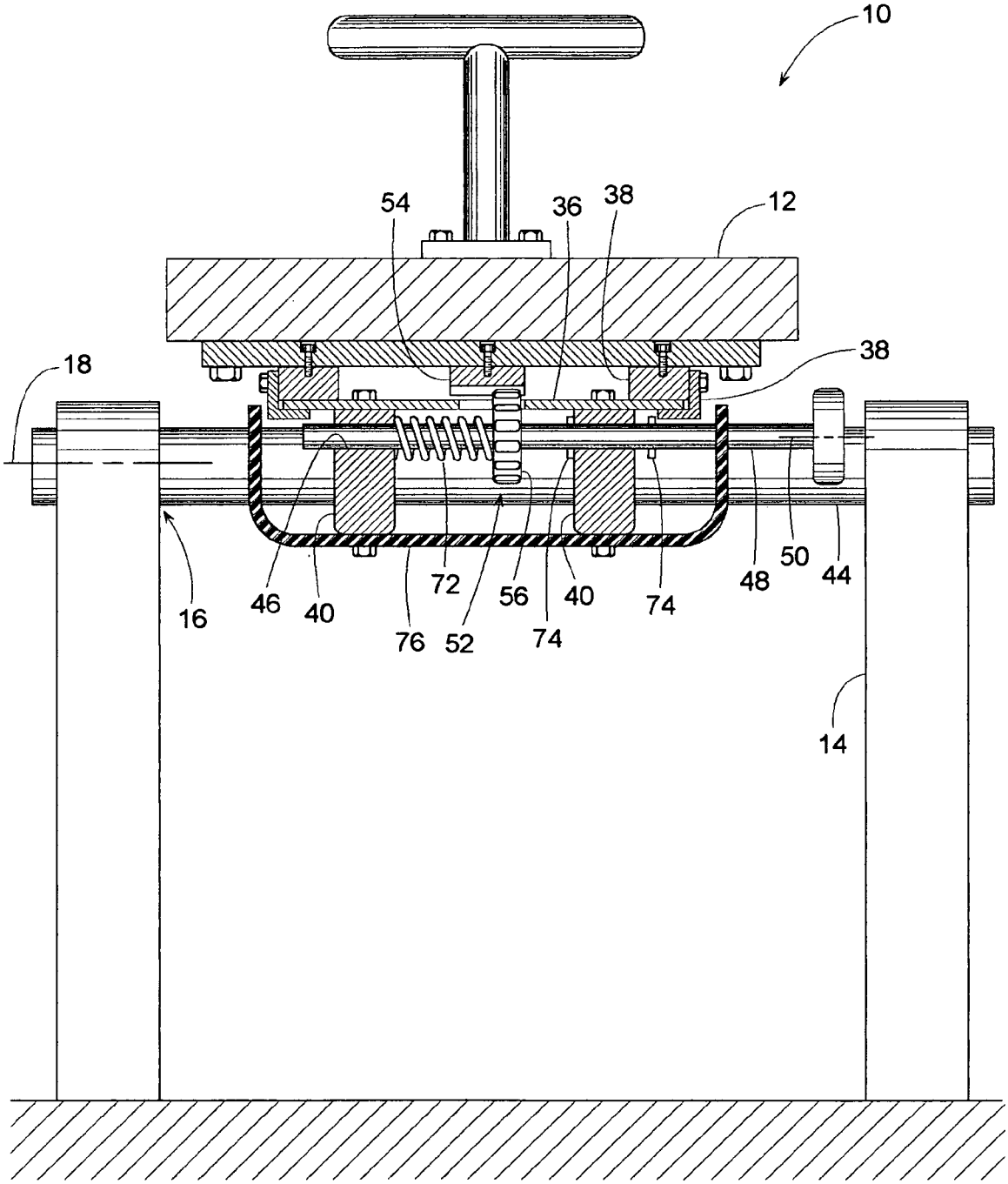
FIG. 2 is a cross-sectional view taken along line 2—2 of FIG. 1, wherein the actuator is in a lock position.

A seesaw 10 shown in FIGS. 1–7 includes a beam 12, such as a plank, mounted for pivotal motion upon a fulcrum. The fulcrum comprises a base 14 with a pivotal coupling 16 that pivotally couples beam 12 to base 14 so that the beam can pivot about a pivotal axis 18. To carry two riders, beam 12 includes a first seat 20 with a first handle 22 for supporting a first person 24 and a second seat 26 with a second handle 28 for supporting a second person 30.

To accommodate a weight differential of the riders, seesaw 10 can be adjusted so that person 24 can sit a first adjustable distance 32 away from axis 18, and person 30 can sit a second adjustable distance 34 away from axis 18. This is done by installing a track follower 36 that can slide along a track 38, which is attached to beam 12. Track follower 36 includes one or more bearing blocks 40 with a first bore 42 that supports a shaft 44 and defines pivotal axis 18. Shaft 44 helps pivotally couple beam 12 to base 14 such that the position of beam 12 relative to axis 18 can be varied by sliding track follower 36 along track 38. Actually track 38 is what moves, and track follower 36 remains generally stationary.

Bearing block 40 also includes a second bore 46 within which a rotatable actuator 48 rotates about its longitudinal centerline 50. Actuator 48 is coupled to a rack-and-pinion assembly 52, which in turn is coupled to beam 12 and base 14. Rotatable actuator 48 is what controls rack-and-pinion assembly 52.

In a currently preferred embodiment, rack-and-pinion 52 includes a gear rack 54 coupled to beam 12 and a pinion gear 56 coupled to and rotatable with actuator 48. Rack 54 is any elongate member with a series of gear teeth, protrusions, discontinuities, elements, holes, voids, detents, etc. Pinion 56 is any rotatable member having a mating series of gear teeth, protrusions, discontinuities, elements, holes, voids, detents, etc. For the illustrated embodiment, pinion 56 has a series of gear teeth 58 that mesh with a series of gear teeth 60 on rack 54. Rack 54, track 38 and beam 12 are substantially parallel to each other.

Figure 3:
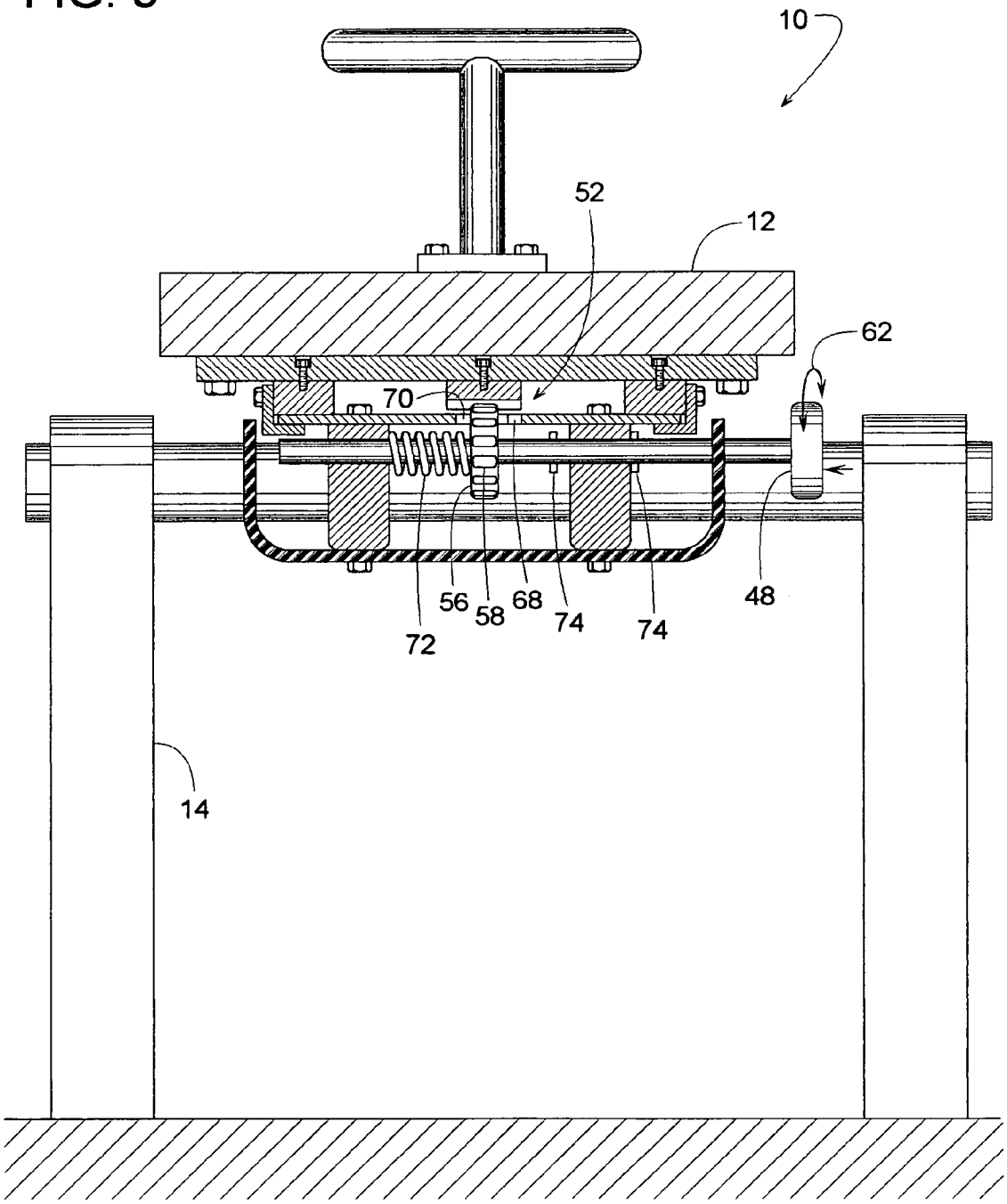
FIG. 3 is a cross-sectional view similar to FIG. 2 but showing the actuator in an unlock position.
Figure 4:
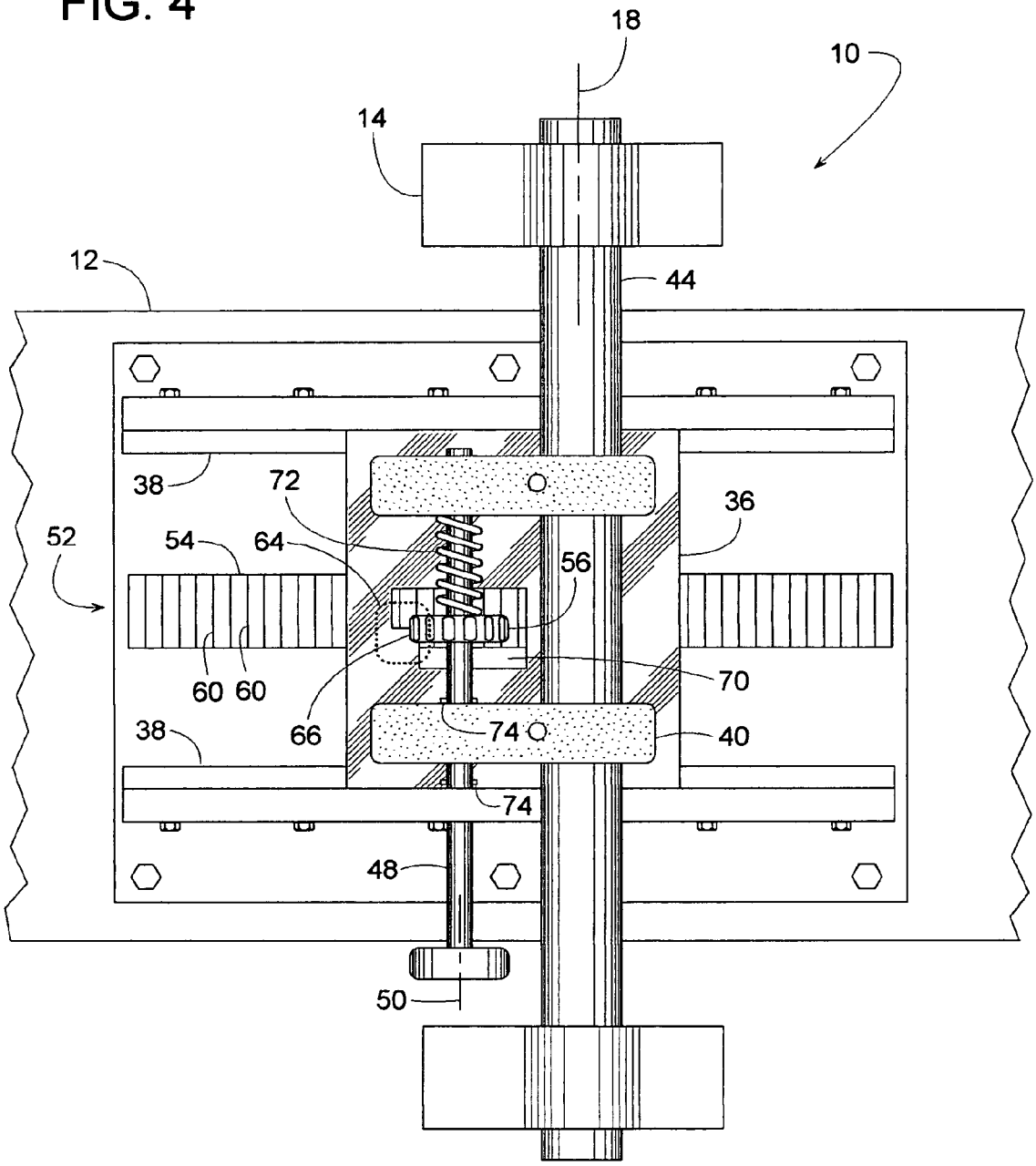
FIG. 4 is a bottom view of a central section of the seesaw, wherein the actuator is in the lock position and the protective cover is omitted to show components that would otherwise be hidden.
Figure 5:
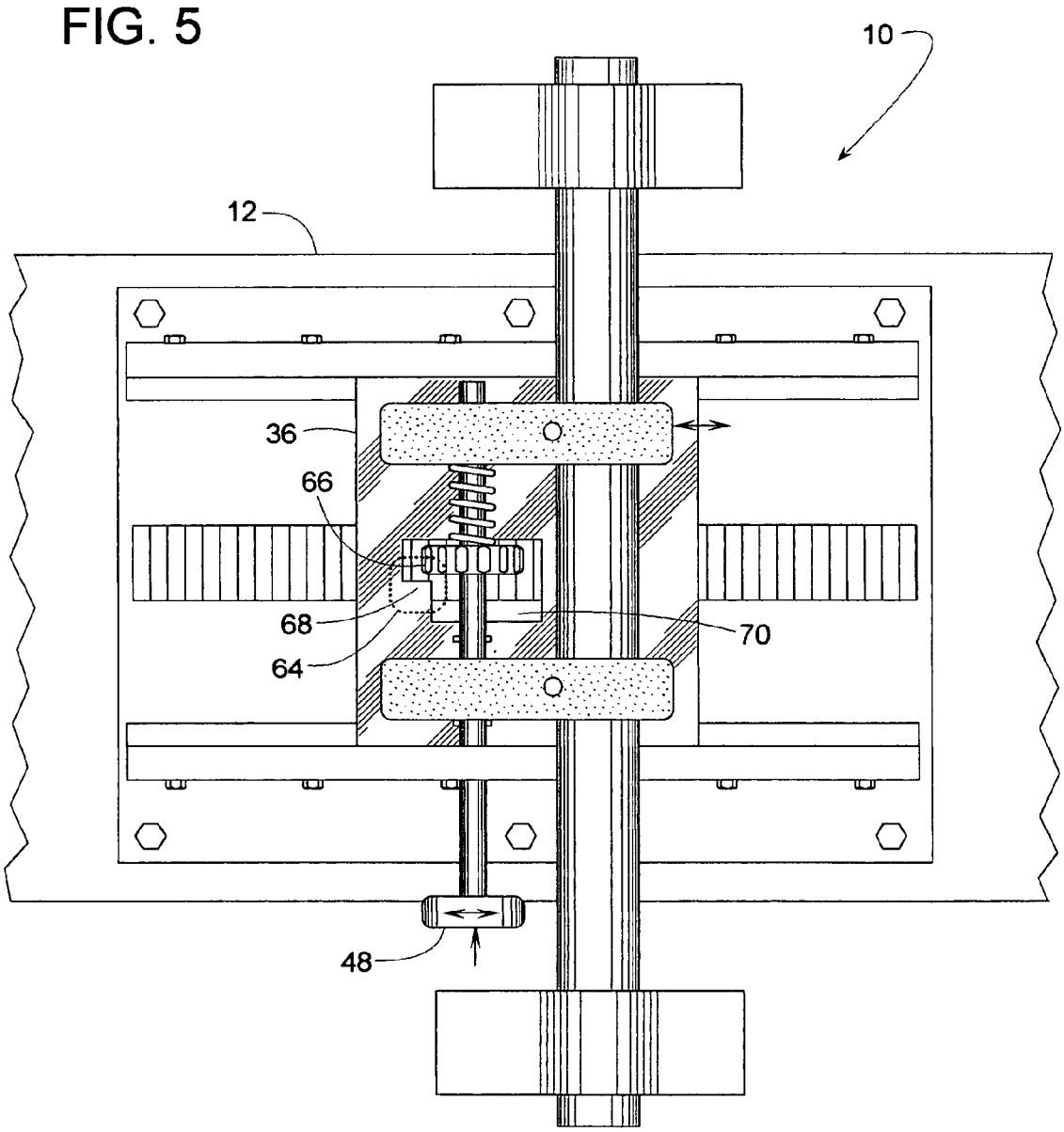
FIG. 5 is a bottom view similar to FIG. 4 but showing the actuator in the unlock position.
Figure 6:
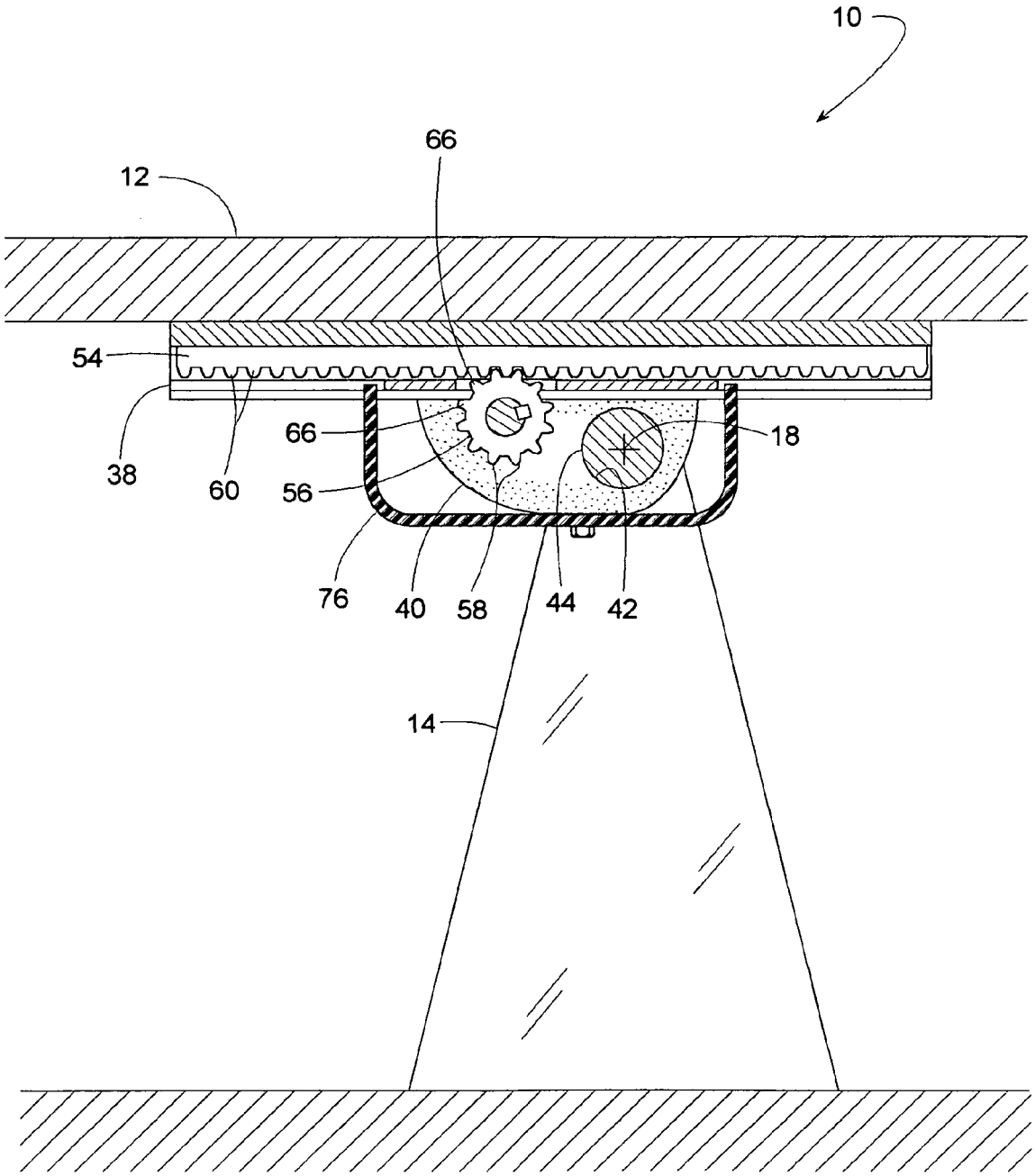
FIG. 6 is a cross-sectional side view of the seesaw at one adjusted position.
Figure 7:
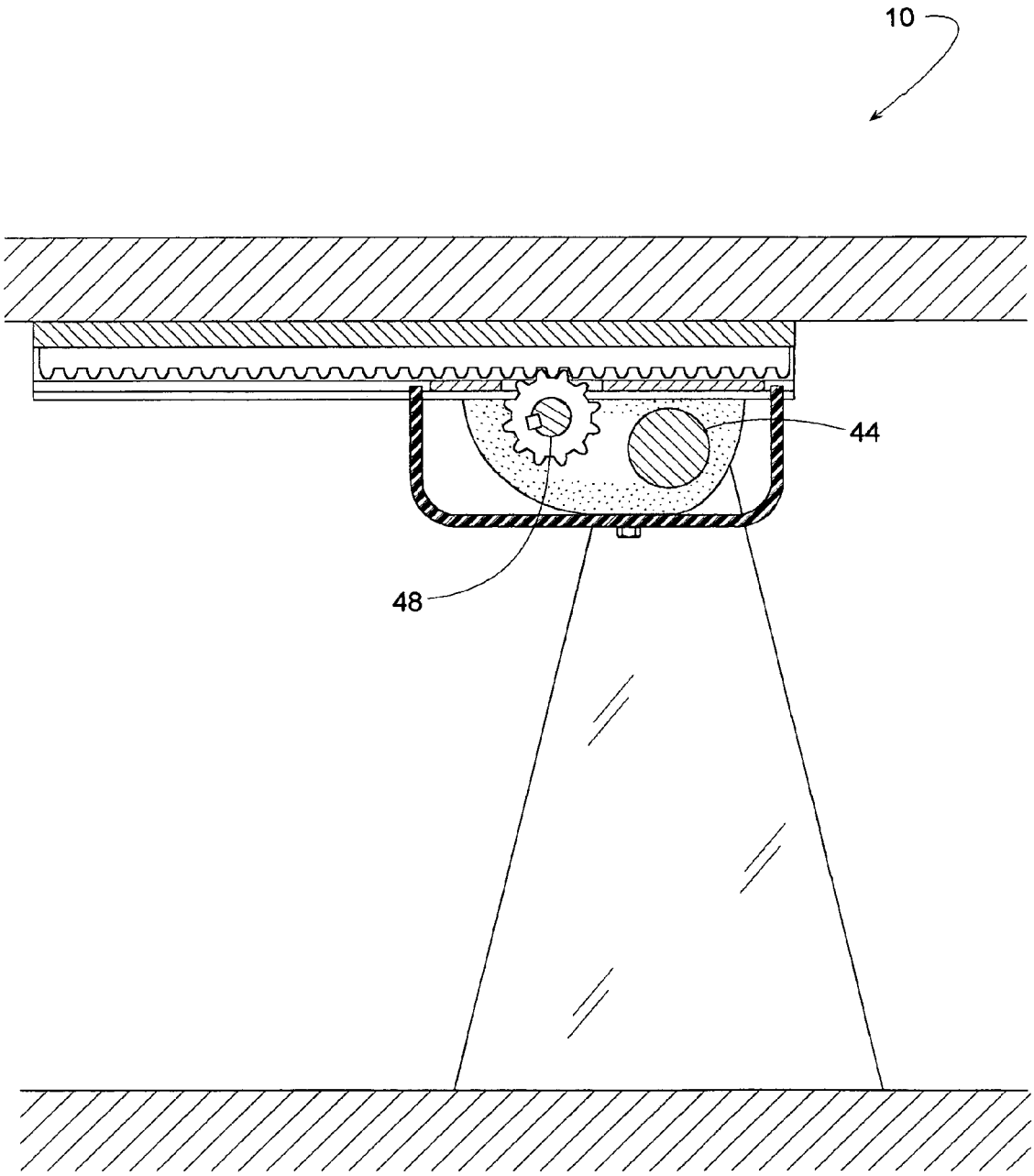
FIG. 7 is a cross-sectional side view of the seesaw at another adjusted position.

When rotational actuator 48 is in the position shown in FIGS. 3 and 5, actuator 48 can be manually rotated to rotate pinion 56. Arrow 62 represents the step of manually rotating pinion 56. With pinion 56 being engaged with rack 54, this forces relative sliding motion between track 38 and track follower 36, whereby track 38, rack 54 and beam 12 translate as a unit relative to track follower 36, shaft 44 and pivotal axis 18. As a result, rotating actuator 48 varies the first adjustable distance 32 and the second adjustable distance 34, thereby providing a means for balancing the seesaw. The rotational direction of actuator 48 determines in which direction beam 12 shifts relative to pivotal axis 18.

After balancing seesaw 10, a locking mechanism 64 can be used to help hold beam 12 at its properly adjusted position. Although the structural design of locking mechanism 64 can vary widely, in a currently preferred embodiment, mechanism 64 is coupled to or is part of rotatable actuator 48. Locking mechanism 64, for instance, may comprise a locking portion 66 that is selectively movable between a lock position (FIGS. 3 and 5) and an unlock position (FIGS. 2 and 4) by sliding actuator 48 along centerline 50. In this example, locking portion 66 is one or more of the pinion's gear teeth 58, which in the lock position engages a tab 68 on track follower 36 and disengages tab 68 in the unlock position. In the lock position, tab 68 inhibits the rotation of pinion 56 and thus inhibits the translation of rack 54 and beam 12. In the unlock position, pinion 56 is free to rotate within an opening 70 of track follower 36 to adjust the position of rack 54 and beam 12. A spring 72 can be used to urge locking mechanism 64 to the normally locked position, and pins 74 or some other type of stopping element can be used to limit the axial travel distance of actuator 48.

To avoid creating a pinching hazard with rack-and-pinion assembly 52 or between track 38 and track follower 36, a protective cover 76 can be attached to track follower 36.

Although the invention is described with reference to a preferred embodiment, it should be appreciated by those of ordinary skill in the art that various modifications are well within the scope of the invention. Many of the various component parts, for instance, are shown assembled by way of threaded fasteners; however, the parts could instead be assembled or manufactured by other means. Bearing blocks 40, for example, could be press-fitted into a mating hole or cavity in track follower 36 as opposed to be held together by screws. Or, various assembled components could be combined as a unitary piece. Therefore, the scope of the invention is to be determined by reference to the following claims.

The invention claimed is:

1. A seesaw for supporting a first person and a second person, the seesaw comprising:

a base;

a beam;

a pivotal coupling that pivotally couples the beam to the base such that the beam can pivot about a pivotal axis;

a first seat on the beam for supporting the first person, wherein the first seat is at a first adjustable distance away from the pivotal axis;

a second seat on the beam for supporting the second person, wherein the second seat is at a second adjustable distance away from the pivotal axis, and the first seat and the second seat are at opposite ends of the beam;

a rack-and-pinion assembly that includes a rack mounted at a substantially fixed location relative to the beam and a pinion engaged with the rack;

a rotatable actuator coupled to and rotatable with the pinion such that rotation of the rotatable actuator rotates the pinion, and rotation of the pinion adjusts a position of the pinion relative to the rack, which in turn varies the first adjustable distance and the second adjustable distance;

a track coupled to the beam and being substantially parallel to the rack; and a track follower coupled to the track such that the track follower can travel along and be guided by the track, wherein the track follower helps support the rotatable actuator and helps define the pivotal axis.

2. The seesaw of claim 1, further comprising a locking device connected to the rotatable actuator, wherein the locking device is selectively movable to a lock position and an unlock position so that the locking device in the lock position inhibits varying the first adjustable distance and the second adjustable distance, and the locking device in the unlock position permits the varying of the first adjustable distance and the second adjustable distance.

3. The seesaw of claim 2, wherein the rotatable actuator is rotatable about a longitudinal centerline, and the locking device moves substantially parallel to the longitudinal centerline upon moving between the lock position and the unlock position.

4. The seesaw of claim 2, wherein the locking device in the lock position engages the track follower, and the locking device in the unlock position disengages the track follower.

5. The seesaw of claim 1, further comprising a first handle adjacent to the first seat and a second handle adjacent to the second seat, wherein the first handle and the second handle are available to help stabilize the first person and the second person respectively.

6. A seesaw for supporting a first person and a second person, the seesaw comprising:

a base;

a beam;

a pivotal coupling that pivotally couples the beam to the base such that the beam can pivot about a pivotal axis;

a first seat on the beam for supporting the first person, wherein the first seat is at a first adjustable distance away from the pivotal axis;

a second seat on the beam for supporting the second person, wherein the second seat is at a second adjustable distance away from the pivotal axis, and the first seat and the second seat are at opposite ends of the beam;

a first handle adjacent to the first seat and a second handle adjacent to the second seat, wherein the first handle and the second handle are available to help stabilize the first person and the second person respectively;

a rack-and-pinion assembly that includes a rack mounted at a substantially fixed location relative to the beam and a pinion engaged with the rack;

a rotatable actuator coupled to and rotatable with the pinion such that rotation of the rotatable actuator rotates the pinion, and rotation of the pinion adjusts a position of the pinion relative to the rack, which in turn varies the first adjustable distance and the second adjustable distance;

a track coupled to the beam and being substantially parallel to the rack;

a track follower coupled to the track such that the track follower can travel along and be guided by the track, wherein the track follower helps support the rotatable actuator and helps define the pivotal axis; and a locking device connected to the rotatable actuator, wherein the locking device is selectively movable to a lock position and an unlock position so that the locking device in the lock position inhibits varying the first adjustable distance and the second adjustable distance, and the locking device in the unlock position permits the varying of the first adjustable distance and the second adjustable distance.

7. The seesaw of claim 6, wherein the rotatable actuator is rotatable about a longitudinal centerline, and the locking device moves substantially parallel to the longitudinal centerline upon moving between the lock position and the unlock position.

8. The seesaw of claim 6, wherein the locking device in the lock position engages the track follower, and the locking device in the unlock position disengages the track follower.

* * * * *